US009915256B2

(12) United States Patent
Bebak et al.

(10) Patent No.: US 9,915,256 B2
(45) Date of Patent: Mar. 13, 2018

(54) MAGNETIC ANTI-GAS LOCK ROD PUMP

(71) Applicant: Baker Hughes Incorporated, Houston, TX (US)

(72) Inventors: Kenneth T. Bebak, Tulsa, OK (US); Carroll Scott DeArman, Owasso, OK (US); Shawn N. Gunter, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 509 days.

(21) Appl. No.: 14/599,002

(22) Filed: Jan. 16, 2015

(65) Prior Publication Data

US 2015/0233370 A1 Aug. 20, 2015

Related U.S. Application Data

(60) Provisional application No. 61/940,667, filed on Feb. 17, 2014.

(51) Int. Cl.

| | |
|---|---|
| ***F04B 47/02*** | (2006.01) |
| ***F04B 7/02*** | (2006.01) |
| ***F04B 53/10*** | (2006.01) |
| ***E21B 43/12*** | (2006.01) |

(52) U.S. Cl.

CPC ..... *F04B 47/02* (2013.01); *E21B 43/127* (2013.01); *F04B 7/0266* (2013.01); *F04B 53/102* (2013.01); *F04B 53/1005* (2013.01); *F04B 53/1082* (2013.01)

(58) Field of Classification Search

CPC ..... F04B 53/1082; F04B 7/02; F04B 7/0266; F04B 47/02; F04B 47/026; F04B 53/1005; F04B 53/126; F04B 53/102–53/1025; F16K 31/086; E21B 43/12; E21B 43/127; E21B 43/125; E21B 34/066

USPC ..... 417/415, 444, 445, 456, 458, 459, 505, 417/510, 514, 545, 552, 555.2, 559, 563, 417/567; 166/68, 68.5, 105, 66.5; 251/65

See application file for complete search history.

(56) References Cited

U.S. PATENT DOCUMENTS 2,192,945 A * 3/1940 Toney ..... E21B 34/16 166/105
2,764,940 A * 10/1956 Long ..... F04B 47/00 137/13
3,055,306 A * 9/1962 Tausch ..... F16K 31/08 251/65

(Continued)

*Primary Examiner* — Alexander Comley
(74) *Attorney, Agent, or Firm* — Bracewell LLP; James E. Bradley

(57) ABSTRACT

A well pump has a standing valve seat with a standing valve mounted in a lower end of a barrel. A plunger is carried within the barrel for axial stoking movement. A travelling seat with a travelling valve are mounted in a lower end of the plunger. The travelling valve has a head that lands on the travelling valve seat while the travelling valve is in a closed position. The travelling valve has a stem extending downward from the head through a hole in the travelling seat. The stem is a permanent magnet. Another permanent magnet is carried by the barrel below the travelling magnet. The polarities of the magnets are configured to interact and cause the travelling valve to lift relative to the travelling seat to an open position as the plunger nears a bottom of a stroke.

15 Claims, 3 Drawing Sheets

(56) References Cited

U.S. PATENT DOCUMENTS 3,476,355 A * 11/1969 Sherwood ..... F16K 31/0682 251/65
3,485,441 A * 12/1969 Eaton, Jr. ..... F04B 3/00 137/512.1
3,510,234 A * 5/1970 Wolf ..... F04B 47/026 417/450
3,578,886 A * 5/1971 Nino ..... F04B 7/0073 417/435
3,773,439 A * 11/1973 Sheridan ..... F04B 17/042 310/103
3,941,516 A * 3/1976 Soberg ..... F04B 5/02 417/259
4,173,451 A * 11/1979 Moore, Jr. ..... F04B 47/02 417/457
4,481,389 A * 11/1984 Johnson ..... F16K 31/086 200/61.86
4,565,246 A * 1/1986 Frazier ..... F04B 53/126 166/112
4,694,860 A * 9/1987 Eidsmore ..... F16K 17/24 137/614.21
4,770,389 A * 9/1988 Bodine ..... E21B 34/04 251/129.04
4,808,089 A * 2/1989 Buchholtz ..... A61M 5/14216 417/417
4,848,454 A * 7/1989 Spears ..... E21B 31/107 166/108
4,867,242 A * 9/1989 Hart ..... E21B 34/06 166/105
5,039,061 A * 8/1991 Heard ..... F16K 31/086 137/553
5,139,398 A * 8/1992 Downing ..... F04B 53/1037 417/511
5,141,404 A * 8/1992 Newcomer ..... F04F 1/08 417/130
5,141,411 A * 8/1992 Klaeger ..... F04B 47/02 417/430
5,249,936 A * 10/1993 McConnell ..... F16K 15/06 417/444
5,472,323 A * 12/1995 Hirabayashi ..... F04B 17/046 310/35
5,655,604 A * 8/1997 Newton ..... E21B 43/12 166/105
6,032,734 A * 3/2000 Telfer ..... E21B 23/00 166/106
6,347,668 B1 * 2/2002 McNeill ..... E21B 21/10 166/105
8,297,367 B2 * 10/2012 Chen ..... E21B 23/00 166/318
2005/0053503 A1 * 3/2005 Gallant ..... F04B 47/00 417/510
2006/0278198 A1 * 12/2006 Savage ..... F02M 59/365 123/446
2007/0289734 A1 * 12/2007 McDonald ..... E21B 34/06 166/66.5
2008/0122299 A1 * 5/2008 Cristoforo ..... H02K 7/075 310/20
2009/0251256 A1 * 10/2009 Fullerton ..... H01F 7/0284 335/296
2009/0292371 A1 * 11/2009 Fullerton ..... A61C 8/0081 623/57
2011/0073319 A1 * 3/2011 Wilson ..... E21B 43/127 166/372
2014/0043126 A1 * 2/2014 Fullerton ..... E05C 19/16 335/306
2015/0024377 A1 * 1/2015 Edwards ..... G01N 33/56911 435/5

* cited by examiner

MAGNETIC ANTI-GAS LOCK ROD PUMP

CROSS REFERENCE TO RELATED APPLICATION

This application claims priority to provisional patent application Ser. No. 61/940,667, filed Feb. 17, 2014.

FIELD OF THE DISCLOSURE

This disclosure relates in general to reciprocating well pump assemblies and in particular to travelling and standing valves that are magnetized to repel each other.

BACKGROUND

Rod pumps are commonly used in oil wells to pump well fluid. A typical rod pump secures to a string of production tubing lowered into a well. The pump has a barrel with a plunger that is stroked within the barrel usually by a string of sucker rods extending to a stroking mechanism at the surface. A traveling valve mounts to the plunger, and a standing valve mounts to the barrel below the plunger.

During an up stroke, well fluid that has entered the plunger will be lifted up the production tubing. During the up stroke, the traveling valve is in a closed position and the standing valve is open to allow well fluid to flow into the barrel. During the down stroke, the standing valve closes and the travelling valve is designed to move to the open position to allow well fluid that has entered the barrel to flow into the plunger.

Some wells produce gas as well as liquid. If the well fluid flowing into the barrel contains gas, the plunger will tend to compress the gas during the down stroke. The compression of the gas can result in not enough liquid being in the barrel to push the travelling valve back to an open position during the down stroke. As a result, the pump can become gas locked and cease to pump liquid up the well.

The well pump assembly disclosed herein has a barrel with an axis and is adapted to be suspended in a well. A standing valve seat is mounted in the barrel. A standing valve is carried on the standing valve seat and is movable relative to the standing valve seat between an open position and a closed position. A plunger is carried within the barrel for axial stoking movement. A travelling seat is mounted in a lower end of the plunger. A travelling valve is carried on the travelling valve seat and is movable relative to the travelling valve seat between an open position and a closed position. A magnetic field cooperatively associated with the travelling valve pushes the travelling valve to the open position as the plunger nears a bottom of a stroke.

In the embodiment shown, the magnetic field is provided in part by a travelling magnet carried by the travelling valve for movement therewith. The magnetic field is also provided by a standing magnet carried by the barrel below the travelling magnet. The travelling magnet and the standing magnet have polarities that repel each other, causing the travelling valve to lift from the travelling valve seat as the travelling magnet approaches the standing magnet.

In the embodiment shown, the travelling valve comprises a head and a stem, the stem extending downward from the head through a hole in the travelling seat, the head being landed on the travelling seat while in the closed position. The stem comprises a travelling magnet, defining part of the magnetic field. The stem has one polarity at a lower end of the stem and an opposite polarity at the head. The travelling seat is formed of a non magnetic material;

In the embodiment shown, the stem extends downward horn the head through a hole in the travelling seat. The head lands on an upper side of the travelling seat and blocks the hole while in the closed position. The stem has an outer diameter less than an inner diameter of the hole, enabling well fluid to flow through the hole in an annulus around the stem while the travelling valve is in the open position.

The standing valve may also comprise a standing valve head and a standing valve stem. The standing valve stem extends downward from the standing valve head through a hole in the standing valve seat. The standing valve head lands on an upper side of the standing valve seat while in the closed position of the standing valve. The standing valve seat is also formed of a non magnetic material. In the embodiment shown, the standing valve stem comprises a standing magnet having one polarity at a lower end of the standing valve stem and an opposite polarity at the standing valve head. The polarity of the standing magnet at the head of the standing valve is configured to repel the travelling magnet. A standing valve annulus may surround the standing valve stem in the hole in the standing seat. Well fluid flows through the annulus while the standing valve is in the open position. The standing valve head blocks the annulus while in the closed position of the standing valve.

BRIEF DESCRIPTION OF THE DRAWINGS

So that the manner in which the features, advantages and objects of the disclosure, as well as others which will became apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
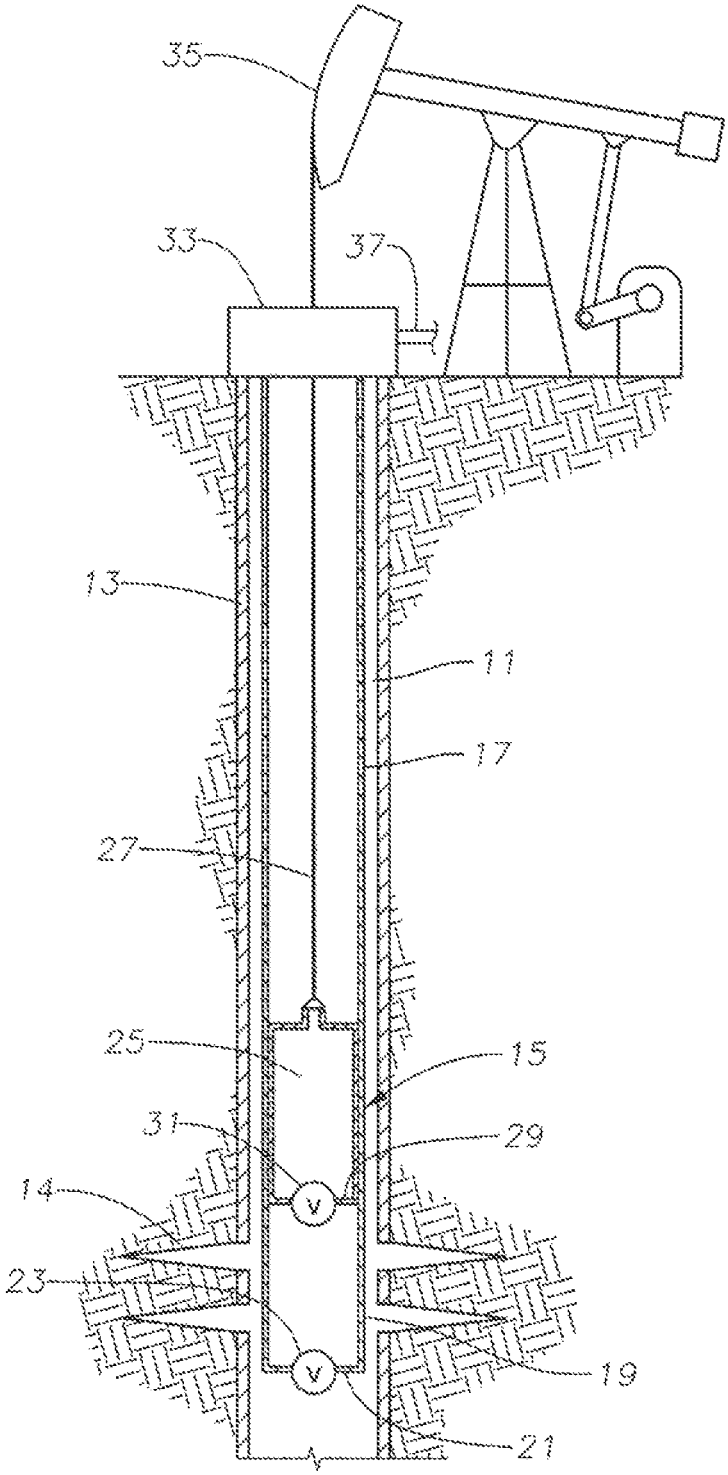
FIG. 1 is a schematic side view of rod pump assembly in accordance with this disclosure installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well 11 has casing 13 that has openings, such as perforations 14, to admit well fluid. A pump assembly 15 is illustrated as being supported on production tubing 17 extending into well 11. Alternately, pump assembly 15 could be supported by other structure, such as coiled tubing.

Pump assembly 15 is a rod-type, having a barrel 19 that is secured to a lower end of tubing 17. Barrel 19 is a tubular member with a polished bore. A standing valve seat 21 is located at the lower end of barrel 19. A standing valve 23 is carried on standing valve seat 21 and moves axially relative to standing valve sear 21 between an open position and a closed position.

A plunger 25 sealingly engages barrel 19 and is stroked between upper and lower positions by a lilting mechanism, such as a string of sucker rod 27. Plunger 25 has a travelling valve seat 29 that moves in unison with plunger 25. A travelling valve 31 is carried on travelling valve seat 29 and is axially movable relative to travelling valve seat 29 between an open position and a closed position.

A wellhead 33 locates at the upper end of casing 13 and supports production tubing 17. Sucker rod 27 extends sealingly through wellhead 33 to a mechanism for stroking sucker rod 27, such as a pump jack 35. A flow line 37 connects to wellhead 33. As pump jack 35 lifts sucker rod 27 and plunger 25, travelling valve 31 closes and plunger 25 will lift the column of well fluid in tubing 17, causing a portion of the column of fluid to flow out flow line 37. At the same time, the upward movement of plunger 25 causes standing valve 23 to open, admitting well fluid from perforations 14 into barrel 19.

When sucker rod 27 moves plunger 25 back downward, travelling valve 31 opens to allow the fluid in barrel 19 to move through travelling valve seat 29. Standing valve 23 closes while plunger 25 moves downward. The lower pressure within barrel 19 created by upward movement of plunger 25 causes standing valve 23 to lift upward from standing valve seat 21. Standing valve 23 closes due to gravity when plunger 25 reaches the upper end of its strobe. Similarly, the higher pressure in barrel 19 created by downward movement of plunger 25 causes travelling valve 31 to open.

Some wells produce gas as well as liquid and the gas can cause gas lock. When plunger 25 is on the down stroke, gas previously drawn into the barrel 19 can compress, rather then pushing travelling valve 31 open. Features described hereinafter serve to prevent gas lock.

Figure 2:
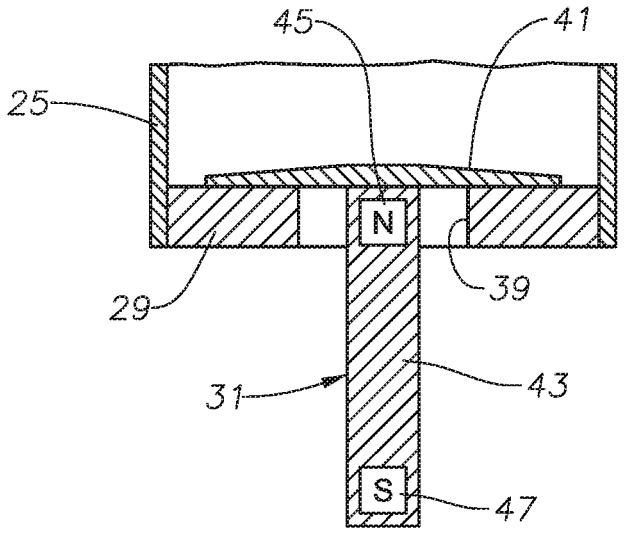
FIG. 2 is an enlarged sectional view of the travelling valve of the pump assembly of FIG. 1.

Referring to FIG. 2, travelling valve seat 29 comprises a plate fixed to the lower end of plunger 25 and having a hole or orifice 39. In this example, travelling valve 31 is in the shape of a tappet having a head 41 in the shape of a disk that lands on travelling valve seat 29 while in the closed position. The diameter of head 41 is greater than the diameter of orifice 39 to block downward flow through orifice 39 when plunger 25 is moving upward. Travelling valve 31 has a stem 43 extending downward from head 41 through orifice 39. Travelling valve 31 is magnetized, having one magnetic pole on head 41 and another on a lower end of stem 43. In this example, the north pole 45 is on head 41 and the south pole 47 on the lower end of stem 43, but that arrangement could be reversed. Travelling valve stem 43 comprise a permanent magnet. Alternately, a permanent magnet could be attached to or form a part of travelling valve stem 43.

In the embodiment shown, the outer diameter of stem 43 is considerably smaller than an inner diameter of orifice 39, defining an annulus surrounding stem 43. While travelling valve 31 is in the open position, well fluid flows through the annulus from the lower to the upper side of travelling valve seat 29. Alternately, orifice 39 could be only slightly smaller than stem 43 and additional holes (not shown) provided outside of orifice 39 for well fluid flow. Valve head 41 would be large enough to block flow through those additional holes while closed.

Figure 3:
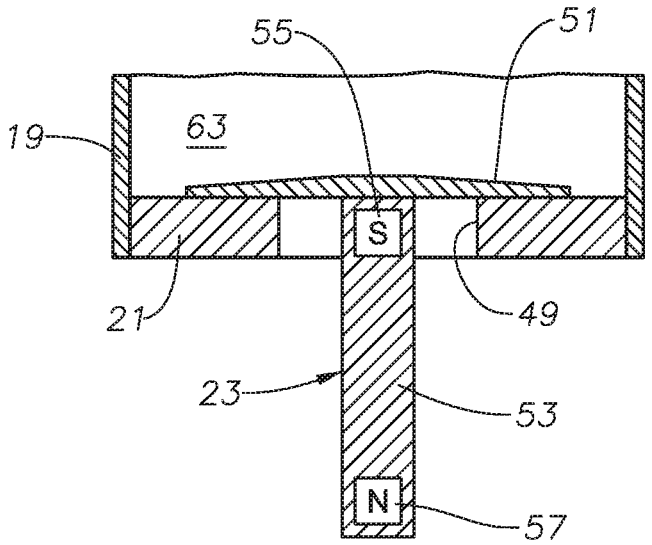
FIG. 3 is an enlarged sectional view of the standing valve of the pump assembly of FIG. 1.

Referring to FIG. 3, standing valve seat 21 is shown as a plate fixed to the lower end of barrel 19 and having a hole or orifice 49. In this embodiment, standing valve 23 is in the shape of a tappet, having a head 51 in the shape of a disk that lands on standing valve seat 21 while in the closed position. The diameter of head 51 is greater that the diameter of orifice 49 to block downward flow through orifice 49 when plunger 25 is moving downward. Standing valve 23 has a stem 53 extending downward front head 51 through orifice 49. Standing valve 23 is magnetized, or a portion of it comprises a permanent magnet, such as stem 53. Stem 53 has one magnetic pole 55 on head 51 and another pole 57 on a lower end of stem 53. The polarity of standing valve 23 is reversed from travelling valve 31. If the south pole 47 is an the lower end of stem 43 of travelling valve 31, as shown, the south pole 55 of standing valve 23 will be on head 51. The north pole 57 will be on the lower end of stem 53.

Travelling valve seat 29 and at least portions of plunger 25 near sear 29 are formed of a nonmagnetic material. Similarly, standing valve seat 21 and at least nearby portions of barrel 19 are formed of non magnetic material.

In the embodiment shown the outer diameter of stem 53 is considerably smaller than an inner diameter of orifice 49, defining an annulus surrounding stem 53. While standing valve 23 is in the open position, well fluid flows through the annulus from the lower to the upper side of standing valve seal 21. Alternately, orifice 49 could be only slightly smaller than stem 53 and additional holes (not shown) provided outside of orifice 49 for well fluid flow. Valve head 51 would be large enough to block flow through those additional holes while closed.

Figure 4:
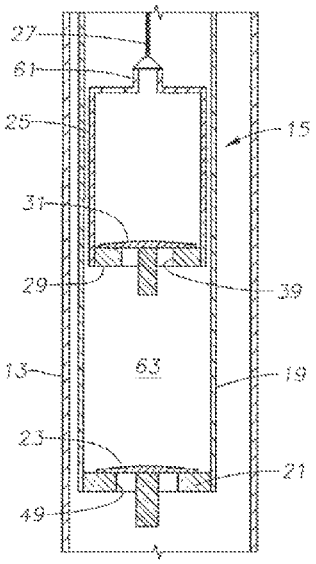
FIG. 4 is a sectional view of the pump assembly of FIG. 1, showing the plunger being at a top of a stroke.

Referring to FIG. 4, plunger 25 has a cylindrical outer surface that is in close, sliding contact with the inner diameter of barrel 19, forming a piston. The clearances shown between the plunger outer surface and the inner diameter of barrel 19 are exaggerated. Plunger 25 is coupled to sucker rod 27 by any suitable connector 61. The portion of plunger 25 above travelling valve seat 29 is not a closed chamber; rather it is open to well fluid in production tubing 17 (FIG. 1) above plunger 25.

During operation, FIG. 4 illustrates plunger 25 at the top of a stroke. Travelling valve 31 and standing valve 23 will each be in the closed position due to gravity, blocking any downward flow of well fluid through travelling valve seat orifice 39 and standing valve seat orifice 49. A variable volume chamber 63 exists in barrel 19 with a lower end at standing valve seat 21 and an upper end at travelling valve seat 29. Chamber 63 will be filled with well fluid from the previous up stroke. The well fluid may be entirely liquid, in which case it is substantially incompressible. Alternately, the well fluid in chamber 63 may be a mixture of liquid and gas, or it may be entirely gas. If gas is present in the well fluid in chamber 63, the well fluid will be compressible.

Figure 5:
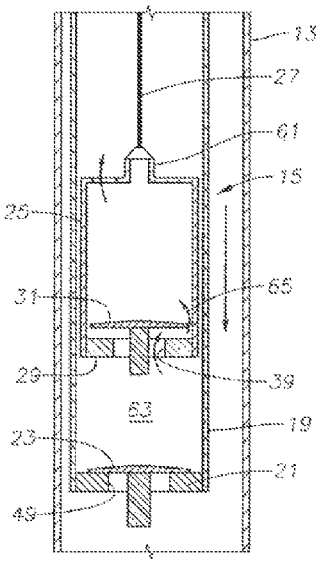
FIG. 5 is a sectional view of the pump assembly of FIG. 1, showing the plunger being stroked downward in the barrel.

Referring to FIG. 5, if the well fluid in chamber 63 is entirely liquid, as plunger 25 moves downward, it will exert a compressive force on the well fluid in chamber 63. Standing valve 23 remains closed during the downward movement of plunger 25. The downward movement of plunger 25 causes the well fluid in chamber 63 to push travelling valve 31 up to the open position. Well fluid in chamber 63 thus flows through travelling valve orifice 39 to above travelling valve seat 29, as indicated by arrows 65.

Figure 6:
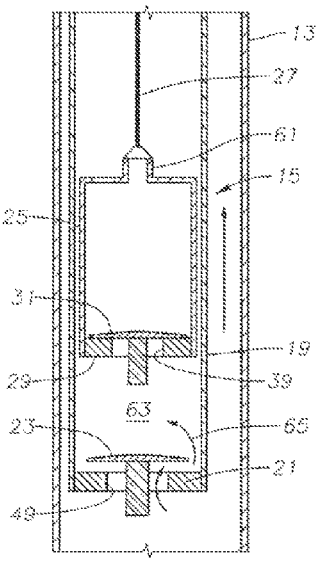
FIG. 6 is a sectional view of the pump assembly of FIG. 1, showing the plunger being stroked upward.

On the up stroke, as shown in FIG. 6, gravity causes travelling valve 31 to move down to the closed position, blocking any flow through travelling valve seat orifice 39. Plunger 25 lifts the weight of the column of well fluid in tubing 11 for the length of the up stroke. The upward movement of plunger 25 creates a suction or lower pressure in barrel chamber 63, causing standing valve 23 to move up to the open position, allowing well thud to flow into chamber 63, as indicated by arrow 65.

If the web fluid in chamber 63 contains a significant amount of gas, on the down stroke, travelling valve 31 may continue to remain closed due to gravity because the downward movement of plunger 25 will be compressing the gas in chamber 63. The upward force on travelling valve 31 due to the compression of the gas might not be enough to lift travelling valve 31 to the open position. However, when travelling valve stem 43 enters the magnetic field of standing valve 23, the magnetic fields of poles 47, 55 (FIGS. 2 and 3) repel each other. The repelling force causes travelling valve 31 to move upward to the open position, allowing the well fluid being compressed in chamber 63 to pass through travelling valve seat orifice 39 into production tubing 17. Preferably, the magnetic fields are strong enough to lift travelling valve 31 before plunger 25 reaches the bottom of its down stroke. The opposed magnetic poles 47, 55 (FIGS. 2 and 3) thus prevent travelling valve 31 from remaining in the closed position all the way to the bottom of the stoke, which could cause gas lock.

While the invention has been shown in only one of its forms, it should be apparent that various changes may be made. For example, instead of tappet configurations, standing valve 23 and travelling valve 31 could be other shapes, such as spherical with a depending pin to maintain each magnetic pole 45, 47 and 55, 57 in a fixed orientation. Alternately, only travelling valve 31 could have a tappet configuration, and standing valve 23 be of conventional design, other than being associated with a magnetic field. Various other arrangements to create an upward magnetic repelling force on travelling valve 31 when plunger 25 nears the bottom of the down stroke are feasible. For example, a magnet with an opposing polarity could be mounted in barrel 19 or on standing valve seat 21, rather than on standing valve 23. Rather than permanent magnets for travelling valve 31 and standing valve 23, electromagnets could be employed. Electrical power would need to be supplied, however. Plunger 23 could be stroked by a downhole electrical motor rather than by sucker rods.

The invention claimed is:

1. A well pump assembly, comprising:

a barrel having an axis and adapted to be suspended in a well;

a standing valve seat mounted in the barrel;

a standing valve that is movable relative to the standing valve seat between a closed position and an open position;

a plunger carried within the barrel for axial stoking movement;

a travelling valve seat mounted in a lower end of the plunger;

a travelling valve that is movable relative to the travelling valve seat between a lower closed position during up stroke movement of the plunger and an upper open position during down stroke movement of the plunger;

a travelling magnet carried by the travelling valve for movement therewith relative to the travelling valve seat, the travelling magnet having a travelling magnetic pole of selected polarity; and a standing magnet carried by the barrel in a location below the travelling magnet, the standing magnet having a standing magnetic pole of the same polarity as the travelling magnetic pole to create a repelling force between the travelling magnetic pole and the standing magnetic pole that pushes the travelling valve to the open position as the plunger approaches the bottom of the down stroke movement.

2. The assembly according to claim 1, wherein:

the travelling valve comprises a head and a stem, the stem extending downward from the head through a hole in the travelling valve seat, the head being landed on the travelling valve seat while in the closed position; and wherein the stem comprises the travelling magnet.

3. The assembly according to claim 1, wherein:

the travelling valve comprises a head and a stem, the stem extending downward from the head through a hole in the travelling valve seat, the head being landed on the travelling seat while in a closed position; and the stem comprises the travelling magnet, and the travelling magnetic pole is at a lower end of the stem.

4. The assembly according to claim 1, wherein:

the travelling valve comprises a head and a stem, the stem extending downward from the head through a hole in the travelling valve seat, the head being landed on an upper side of the travelling valve seat while in a closed position;

the travelling valve seat is formed of a non magnetic material; and the stem comprises the travelling magnet, and the travelling magnetic pole is at a lower end of the stem.

5. The assembly according to claim 1, wherein:

the standing magnet is carried by the standing valve for movement therewith between the open and closed positions.

6. The assembly according to claim 1, wherein:

the travelling valve comprises a travelling valve head and a travelling valve stem, the travelling valve stem extending downward from the head through a hole in the travelling valve seat, the travelling valve head being landed on an upper side of the travelling valve seat while in a closed position;

the travelling valve seat is formed of a non magnetic material;

the travelling valve stem comprises the travelling magnet, the travelling magnetic pole being at a lower end of the travelling valve stem;

the standing valve comprises a standing valve head and a standing valve stem, the standing valve stem extending downward from the standing valve head through a hole in the standing valve seat, the standing valve head being landed on an upper side of the standing valve seat while in a closed position;

the standing valve seat is formed of a non magnetic material; and the standing valve stem comprises the standing magnet, the standing magnetic pole being at the standing valve head of the standing valve.

7. A well pump assembly, comprising:

a barrel having an axis and adapted to be suspended in a well;

a standing valve seat mounted in a lower end of the barrel;

a standing valve carried on the standing valve seat and being axially movable relative to the standing valve seat between an upper open position, which admits well fluid into the barrel, and a lower closed position, which blocks downward flow out of the barrel;

a plunger carried within the barrel for axial stoking movement between a down stroke movement and an up stroke movement;

a travelling valve seat mounted in a lower end of the plunger, the travelling valve seat having a hole therethrough;

a travelling valve having a travelling valve head that lifts above the travelling valve seat to an upper open position during the down stroke movement to admit well fluid into the plunger and lands on the travelling valve seat in a lower closed position during the up stroke movement, the travelling valve having a travelling valve stem extending downward from the travelling valve head through the hole, the stem comprising a travelling magnet with a travelling magnetic pole on a lower end of the travelling valve stem; and a standing magnet carried by the barrel at a location axially spaced below the travelling magnet, the standing magnet having a standing magnetic pole of the same polarity as the travelling magnetic pole to create a repelling force between the travelling magnetic pole and the standing magnetic pole while the plunger approaches the bottom of the down stroke movement that causes the travelling valve to lift relative to the travelling valve seat to the open position as the plunger nears the bottom of the down stroke movement.

8. The assembly according to claim 7, wherein:

the standing magnet is movable with the standing valve between the open and closed positions.

9. The assembly according to claim 7, wherein:

the standing valve comprises a standing valve head and a standing valve stem, the standing valve stem extending downward from the standing valve head through a hole in the standing valve seat, the standing valve head being landed on an upper side of the standing valve seat while in the closed position of the standing valve;

the standing valve stem comprises the standing magnet; and the standing magnetic pole is at the standing valve head of the standing valve.

10. The assembly according to claim 7, wherein:

the standing valve comprises a standing valve head and a standing valve stem, the standing valve stem extending downward from the standing valve head through a hole in the standing valve seat, the standing valve head being landed on an upper side of the standing valve seat while in the closed position of the standing valve;

the standing magnet forms a part of the standing valve and the standing magnetic pole is at the standing valve head; and the standing valve stem has an outer diameter less than an inner diameter of the hole in the standing valve seat, enabling well fluid to flow through the hole in the standing valve seat in an annulus around the standing valve stem while the standing valve is in the open position.

11. The assembly according to claim 7, wherein:

the travelling valve seat and the standing valve seat are formed of non magnetic material.

12. A method of pumping well fluid from a well, comprising:

(a) providing a reciprocating pump with a barrel, a standing valve mounted to the barrel, a travelling valve mounted to a plunger, with a travelling magnet carried by the travelling valve, the travelling magnet having a lower end with a travelling magnetic pole of selected polarity, and a standing magnet carried by the barrel below the plunger, the standing magnet having an upper end with a standing magnetic pole of the same polarity as the travelling magnetic pole;

(b) suspending the pump in the well;

(c) stroking the plunger downward in the barrel, causing the standing valve to move to a lower closed position and the travelling valve to move to an upper open position in response to well fluid contained in the barrel, thereby admitting well fluid contained in the barrel into the plunger; and (d) as the plunger nears a bottom position, creating a repelling force between the travelling magnetic pole and the standing magnetic pole that pushes the travelling valve upward to the open position.

13. The method according to claim 12, further comprising:

after reaching the bottom of a stroke in step (d), lifting the plunger, thereby causing the travelling valve to move to a closed position in response to a weight of the well fluid within the plunger.

14. The method according to claim 12, wherein step (a) comprises:

providing the travelling valve with a travelling seat;

mounting the travelling magnet to the travelling valve for movement therewith relative to the travelling seat; and wherein step (d) causes the travelling valve to move upward relative to the travelling seat.

15. The method according to claim 12, wherein step (a) comprises:

providing the travelling valve with a travelling seat having a hole therethrough;

providing the travelling valve with a head that lands on an upper side of the travelling seat and a stem that extends through the hole, the stem comprising the travelling magnet; and wherein step (d) causes the travelling valve to move upward relative to the travelling seat, and well fluid to flow through an annulus between the stem and the hole.

* * * * *